United States Patent [19]

Peterson

[11] 4,322,781

[45] Mar. 30, 1982

[54] UNIFORMLY LIGHTED PATTERN DISPLAY

[75] Inventor: Wesley R. Peterson, Boundbrook, N.J.

[73] Assignee: The Singer Company, Stamford, Conn.

[21] Appl. No.: 165,584

[22] Filed: Jul. 3, 1980

[51] Int. Cl.[3] ..... F21V 7/04

[52] U.S. Cl. ..... 362/32; 362/26; 362/90; 362/297; 362/346

[58] Field of Search ..... 362/32, 26, 90, 297, 362/346

[56] References Cited

U.S. PATENT DOCUMENTS 4,124,879 11/1978 Schoemer ..... 362/32 X 4,177,501 12/1979 Karlin ..... 362/32 X

*Primary Examiner*—Stephen J. Lechert, Jr.

*Attorney, Agent, or Firm*—James M. Trygg; Robert E. Smith; Edward L. Bell

[57] ABSTRACT

A lighted display device having an array of discrete reflective surfaces each of which is associated with a visual display. The reflectivity of each of the surfaces is established so that the light reflected to, and illuminating, each associated visual display is of equal intensity independent of the distance of the reflective surface from the light source.

16 Claims, 3 Drawing Figures

UNIFORMLY LIGHTED PATTERN DISPLAY

BACKGROUND OF THE INVENTION

This invention relates to visual display devices and, more particularly to the uniform illumination of display panels.

There are two general methods of illuminating a display panel. The most common utilizes a single light source arranged so that an acceptable level of light is cast on all viewable areas of the display. This method produces a non-uniform light intensity over the viewing area of the display since the light intensity at a specific point is inversely proportional to the square of the distance between the point and the light source. In cases where the display is fairly compact and all of the viewing areas are approximately the same distance from the light source, the non-uniform lighting is not a serious disadvantage. However, where the display is of irregular shape or of rather long, rectangular shape and where the viewing areas are at substantially varying distances from the light source, the variation in light intensity can be undesirable. To help alleviate this problem a second method of illuminating a display panel was utilized whereby multiple light sources are selectively spaced about the panel in an arrangement that reduces the wide variation in light intensity formed with some of the single light source devices. Here again, however, there may be considerable non-uniformity of light intensity within the viewing field. Additional complexities inherent in this method and resulting increased costs detract from its desirability. Other attempts at solving this problem have centered about the use of "frosted glass" defusers and the like. These attempts have not met with complete success. Another attempt at solving this problem is disclosed in British Pat. No. 1,337,055, Oct. 25, 1972, Bubbins, wherein a single light source is positioned at the focal point of a parabolic shaped reflector which produces a planar field of light of uniform intensity. This method, however, has the disadvantage of being bulky and is difficult to incorporate into existing display designs. The present invention overcomes these difficulties of the prior art by the use of a novel but relatively simple device.

SUMMARY OF THE INVENTION

It is an object of this invention to produce a relatively compact visual display device for use with a sewing machine. It is another object of this invention to produce a visual display device illuminated over its entire viewable field with light of substantially uniform intensity.

Other objects and advantages of the invention will become apparent through reference to the accompanying drawings and descriptive matter which illustrates a preferred embodiment of this invention.

According to the present invention there is provided a lighted display having an array of discrete reflective surfaces supported at varying distances from a light source. There is a visual display associated with each reflective surface and positioned for viewing by the operator. Each reflective surface has a reflectivity inversely proportional to the square of its distance from the light source so that the intensity of light reflected by each surface to its respective associated visual display is substantially equal.

BRIEF DESCRIPTION OF THE DRAWINGS

In order that the invention be more fully understood it will now be described by way of example with reference to the accompanying drawings in which.

DETAILED DESCRIPTION OF THE INVENTION

Figure 1:
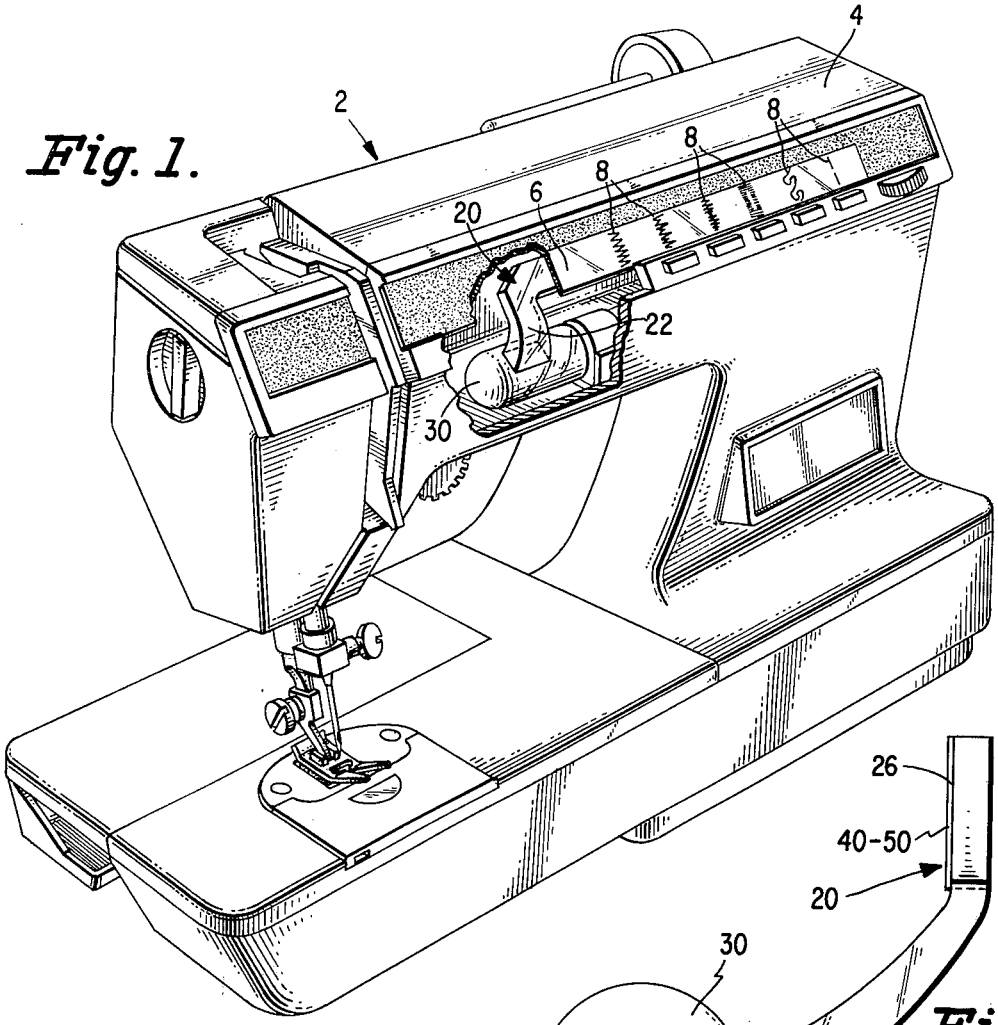
FIG. 1 is a perspective view of a sewing machine with a partial cut-away showing structure incorporating this invention.
Figure 3:
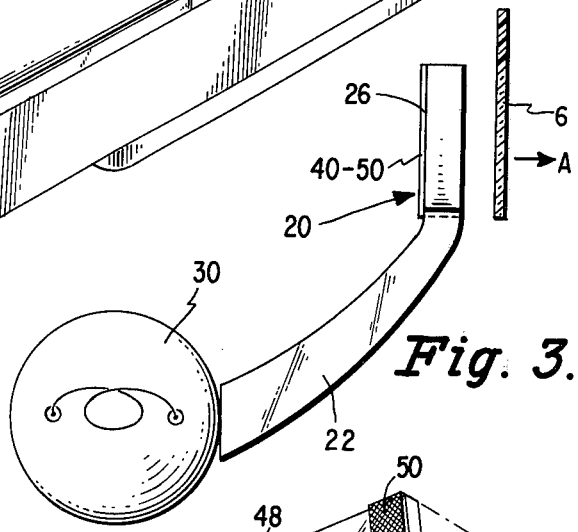
FIG. 3 is an end view taken along lines 3—3 of FIG. 2.
Figure 2:
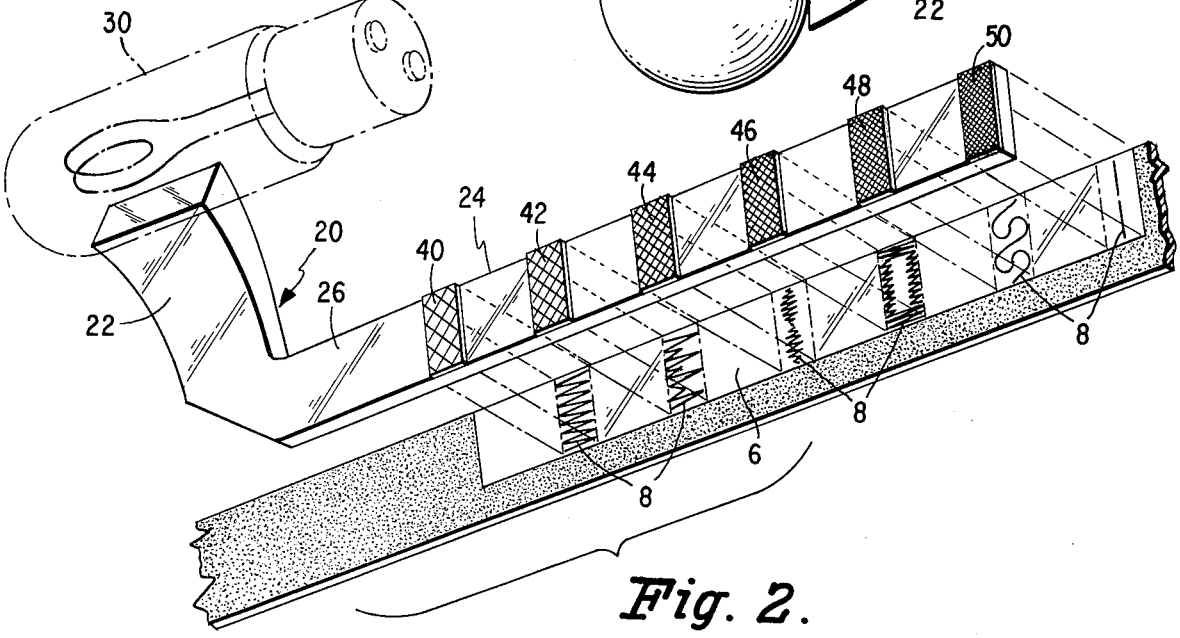
FIG. 2 is a front view of the display device incorporating the teachings of this invention.

Referring to FIGS. 1 through 3 there is shown a sewing machine 2 having a horizontal arm 4 within which is mounted a display panel 6 positioned for easy viewing by the operator. The display panel 6 is transparent to light and has affixed thereto several replicas 8 of stitch patterns that may be selected by the operator and sewn by the machine.

A light pipe 20, made of a transparent thermoplastic resin has a body 24 which is positioned directly adjacent to the display panel 6, and has an extremity 22 projecting downward and into close proximity to a light source or lamp 30. A series of reflective surfaces 40, 42, 44, 46, 48 and 50 are placed in contact with the back surface 26 of the light pipe 20. These reflective surfaces, in the preferred embodiment, are composed of matrices of white dots of paint applied directly to the back surface 26. The reflective surface 48 has fewer white dots per unit area than the surface 50. The surface 46 has fewer dots than the surface 48 and so on to the surface 40 which has the fewest white dots per unit area. Since the surface 40 has the fewest white dots per unit area and each succeeding surface 42 through surface 50 having respectively more white dots per unit area, the surface 40 will have the lowest reflectivity while each succeeding surface 42 through surface 50 will have a respectively higher reflectivity. While the preferred embodiment varies the quantity of white dots per unit area in order to vary reflectivity, a fixed quantity and spacing of dots per unit area could be established and the shape and size of the dots varied. Both methods will work equally well.

The percentage of white dots per unit area for each of the reflective surfaces 40–50 is selected so that the resulting reflectivity of each surface is inversely proportional to the square of the light path distance from the surface to the light source 30 and so that light from the light source 30 will reflect from each of the surfaces 40–50 with substantially equal intensity.

In operation, light from the lamp 30 enters the extremity 22 of the light pipe 20 and spreads throughout the entire interior of the light pipe. As the light moves away from the extremity 22 toward the other end of the light pipe 20, its intensity diminishes. The reflective surfaces 40 through 50 reflect this light outwardly in the direction of the arrow A shown in FIG. 3. The light has an intensity directly proportional to the reflectivity of each surface and to the amount of light received. The change in reflectivity from surface to surface exactly corresponds to and counters the change in amount of light received so that the resulting light that is reflected outwardly in the direction of the arrow A from each surface will be of equal intensity. The light so reflected illuminates the patterns 8 of the display panel 6 for viewing by the operator. The operator may then adjust a pointer or the like, not shown, to select a desired pattern for sewing.

Upon reviewing the present disclosure, a number of alternative constructions will occur to one skilled in the art. Such constructions may utilize various methods to illuminate the discrete reflective surfaces as, for example, fibre optics, direct radiation, back or front illumination et al. Additionally, various means may be utilized to vary the reflectivity of the reflective surfaces as, for example, lines painted on or otherwise applied to the surface or variations in color or texture of the surface. All such alternative constructions are considered to be within the spirit and scope of this disclosure and are presented here as examples for illustrative purposes only and are not to be deemed as limitations of this invention.

I claim:

1. A lighted display having:

(a) an external light source;

(b) an array of discrete reflective surfaces supported at varying distances from said light source; and (c) a visual display associated with each said reflective surface and positioned for viewing by an operator;

wherein each of said reflective surfaces has a reflectivity inversely proportional to the square of the distance of said surface from said light source so that the intensity of light reflected by each of said surfaces to their respective said associated visual displays may be substantially equal.

2. A lighted display as set forth in claim 1 wherein each said reflective surface comprises a matrix of white dots, the percentage of area covered by said dots defining said reflectivity.

3. A lighted display as set forth in claim 2 wherein said percentage of area covered by said dots is established by the mutual spacing of said dots.

4. A lighted display as set forth in claim 2 wherein said percentage of area covered by said dots is established by the physical size and shape of said dots.

5. A lighted display as set forth in claim 4 wherein said physical shape of said dots is substantially circular.

6. A lighted display as set forth in claim 2 wherein said white dots are paint.

7. A lighted display as set forth in claims 1, 2 or 6 wherein said reflective surfaces are arranged on a surface of a transparent thermoplastic resin light pipe.

8. A lighted display as set forth in claims 1, 2 or 6 wherein said reflective surfaces are arranged on a surface of a display panel.

9. In combination, a sewing machine having a plurality of operator influencable functions and a lighted display having:

(a) a light source;

(b) a plurality of representative visual displays of said operator influencable functions positioned for viewing by the operator;

(c) an array of discrete reflective surfaces supported at varying distances from said light source, each of which is associated with one of said representative visual displays and has a reflectivity inversely proportional to the square of the distance of said surface from said light source so that the intensity of light reflected by each of said surfaces to their respective said representative visual displays may be substantially equal.

10. A combination as set forth in claim 9 wherein each of said reflective surfaces includes an arrangement of white dots, the percentage of area covered by said dots in relation to the total area of said reflective surface defining said reflectivity.

11. A combination as set forth in claim 10 wherein said percentage of area covered by said dots is established by relative positioning of said dots.

12. A combination as set forth in claim 10 wherein said percentage of area covered by said dots is established by the physical size and shape of said dots.

13. A combination as set forth in claim 12 wherein said physical shape of said dots is substantially circular.

14. A combination as set forth in claim 10 wherein said white dots are paint.

15. A combination as set forth in claims 9, 10 or 14 wherein said reflective surfaces are arranged on a surface of a transparent thermoplastic resin light pipe.

16. A combination as set forth in claims 9, 10 or 14 wherein said reflective surfaces are arranged on a surface of a display panel.

* * * * *